United States Patent [19]

Palthe

[11] 4,154,026

[45] May 15, 1979

[54] ABRADING TOOL

[76] Inventor: John W. Palthe, 3068 S. Owasso Blvd., Roseville, Minn. 55113

[21] Appl. No.: 886,728

[22] Filed: Mar. 15, 1978

[51] Int. Cl.[2] ..... B24D 17/00

[52] U.S. Cl. ..... 51/361; 51/382; 51/403; 51/293; 51/295

[58] Field of Search ..... 51/170 PT, 245, 328, 51/358, 359, 360, 361, 376, 382, 387, 388, 403, 295, 293

[56] References Cited

U.S. PATENT DOCUMENTS

| | | | |
|---|---|---|---|
| 2,115,210 | 4/1938 | Mulholland | 51/382 |
| 2,458,362 | 1/1949 | Field | 51/403 |
| 2,722,092 | 11/1955 | Meinerding | 51/403 |
| 2,725,693 | 12/1955 | Smith | 51/403 X |

*Primary Examiner*—Harold D. Whitehead

*Assistant Examiner*—Robert P. Olszewski

*Attorney, Agent, or Firm*—William L. Huebsch

[57] ABSTRACT

A tool for releasably supporting a length of abrasive strip material in a generally cylindrical coil with its abrasive surface out and for transferring torque from a drive chuck to rotate the coiled strip about its axis so that the outer surface of the strip may be used to abrade a workpiece. The tool includes a body member including a driven end portion adapted to be engaged by the chuck, a cylindrical central transfer portion, and a cylindrical supporting end portion about which the inner surface of the coiled length of abrasive strip material is supported. A coil spring has one end portion which fits closely about the outer surface of the transfer portion and an opposite end portion which engages the outer surface of the coiled length of abrasive strip material both to hold it in place and to transfer torque to it from the driven body member.

12 Claims, 3 Drawing Figures

ABRADING TOOL

BACKGROUND OF THE INVENTION

The present invention relates to tools for supporting and transferring rotational forces to abrasive material to provide a rotating cylindrical abrasive surface for abrading a workpiece.

The prior art is replete with tools which support and transfer rotational forces to an abrasive material to provide a rotating cylindrical abrasive surface for use in abrading a workpiece. Typically such tools comprise a cylindrical drum having a coaxial stem projecting from one end and adapted to be engaged by a drive chuck for rotating the drum. In one such tool the peripheral surface of the drum can be expanded to frictionally engage the inner surface of a hollow cylindrical abrasive strip which is supported and rotated with the tool, whereas with another the abrasive strip is adhered around the drum via pressure sensitive adhesive.

While such tools can do a good job of abrading, replacement cylindrical or pressure sensitive adhesive coated abrasive strips are more expensive to make and buy than plain abrasive strip material.

SUMMARY OF THE INVENTION

According to the present invention there is provided a simple tool which can releasably support a length of plain abrasive strip material in a coil with its abrasive surface out to provide a generally cylindrical outer abrasive surface, and can transfer forces to rotate the coiled length of abrasive strip material about its axis so that its outer surface may be used to abrade a workpiece such as to shape, smooth or polish a surface or to size or polish a hole.

The tool according to the present invention comprises a body member having an axis, a driven end portion adapted to be engaged by a drive chuck for rotating the tool in a first rotational direction about the axis, and adjacent transfer and supporting portions having peripheral surfaces which are cylindrical about the axis. The supporting portion is adapted to support the length of abrasive strip material in a generally cylindrical coil about its peripheral surface with the coil wound in a direction opposite the direction in which the tool is to be rotated. A spring wound in a direction opposite the direction which the body member is to be rotated has one end portion fitting closely around the transfer portion and an opposite end portion adapted to encircle an end portion of the coiled length of abrasive strip material to releasably hold it on the supporting portion and to transfer torque to it from the body member.

Preferably the supporting portion is an end portion of the body member so that it may be projected into an opening to abrade its inner surface. Also preferably the supporting portion has a diameter which is smaller than the diameter of the transfer portion and is adapted so that the portion of the coil of abrasive strip material supported about it which is engaged by the spring will have the same diameter as the transfer portion; and both end portions of the coil spring have the same inner diameter.

The length of abrasive material used on the tool may be of a uniform width and predetermined length so that the strip has a uniform generally cylindrical outer surface of a predetermined diameter adapted to be engaged by the spring. Alternatively the strip may have a wide end portion with a predetermined length so that when coiled it will provide an end portion of the predetermined diameter for the spring to engage, and a narrow end portion which is coiled around the wide end portion and provides a generally cylindrical surface of some larger diameter. This larger diameter may be adjusted for various purposes by shortening or lengthening the narrow end portion; for example, to provide the proper diameter to size or polish a hole.

BRIEF DESCRIPTION OF THE DRAWING

The present invention will be further described with reference to the accompanying drawing where like numbers refer to like parts in the several views, and wherein.

DESCRIPTION OF THE PREFERRED EMBODIMENT

Figure 1:
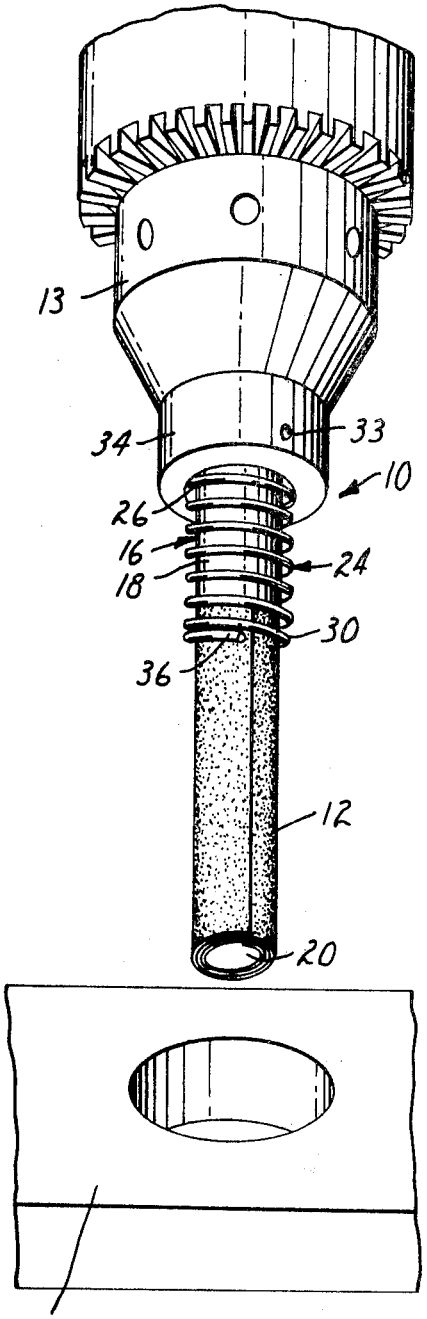
FIG. 1 is a perspective view of a tool according to the present invention supported in a drive chuck and supporting a coil of abrasive strip material which has a generally cylindrical abrasive outer surface of a uniform diameter.

Referring now to the drawing there is illustrated a tool 10 according to the present invention which is adapted to support and retain a length of abrasive strip material 11 or 12 (e.g. cloth backed coated abrasive) in a generally cylindrical coil with its abrasive surface out, and to transfer torque in a first rotational direction from a rotating drive means or chuck 13 to rotate the coiled length of abrasive strip material 11 or 12 about its axis so that its outer surface may be used to abrade a workpiece 14.

Figure 3:
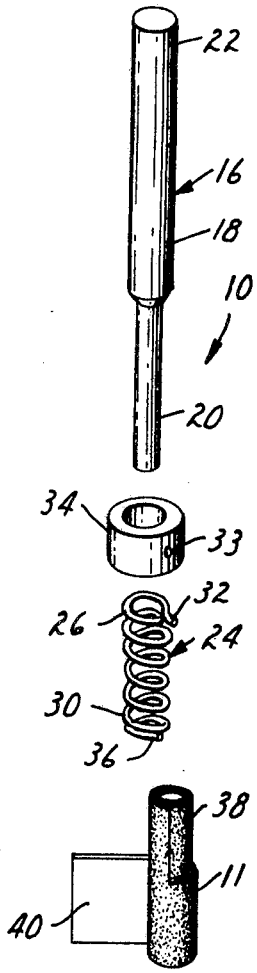
FIG. 3 is an enlarged exploded view of the tool of FIG. 1 and of a coiled length of abrasive strip material which has one end portion adapted to be engaged by a spring on the tool and an opposite cylindrical end portion of a larger diameter.

As is best seen in FIG. 3, the tool 10 comprises a stepped cylindrical body member 16 (preferably of steel) and having an axis, a central transfer portion 18 with a cylindrical peripheral surface about the axis with a predetermined diameter, and a supporting end portion 20 with a cylindrical peripheral surface about the axis having a diameter which is smaller than the transfer portion 18. The supporting portion 20 is coaxial with and projects from one end of the transfer portion 18, and has a length and diameter adapted to support the coiled length of abrasive strip material 11 or 12 about its periphery with the outer surface of the portion of the coiled length of abrasive strip material 11 or 12 adjacent the transfer portion 18 generally aligned with the outer surface of the transfer portion 18. The body member 16 also includes a driven end portion 22 about the axis on the end of its central transfer portion 18 opposite the supporting end portion 20 which is coaxial with the transfer and supporting portions 18 and 20, and is adapted to be received in a drive chuck such as the chuck 13. The driven end portion 22 is illustrated as being cylindrical and of the same diameter as the transfer portion 18, but could be of a diameter different than that of the transfer portion 18 and/or could have flatted surface portions to facilitate engagement by the chuck 13.

Figure 2:
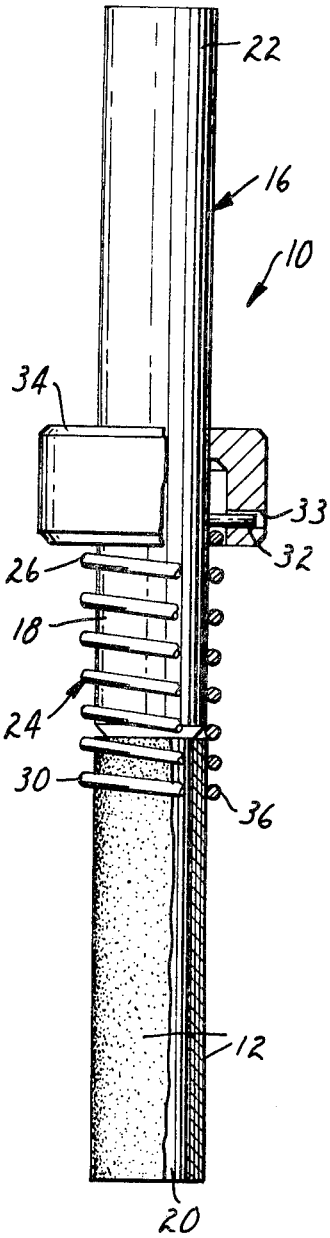
FIG. 2 is an enlarged plan view of the tool of FIG. 1 and of the coiled length of abrasive strip material in which parts are broken away to show detail.

The tool 10 also includes a coil spring 24 helically wound in a direction opposite the direction the tool 10 is adapted to be rotated, which coil spring 24 provides means both for releasably holding the length of abrasive strip material 11 or 12 in a coil about the supporting end portion 20 of the body member 16, and for transferring torque received by the body member 16 from the chuck to the coiled length of abrasive strip material 11 or 12 to rotate its abrasive outer surface against a workpiece. The spring 24 has an inner diameter approximately equal to the outer diameter of both the transfer portion 18 and the outer surface of the portion of the coiled length of abrasive strip material 11 or 12 adjacent the transfer portion 18, and has a length adapted so that one end portion 26 of the spring 24 may be positioned around the transfer portion 18 of the body member 16 and the opposite end portion 30 of the spring may be positioned around a portion of the coil of abrasive strip material 11 or 12 on the supporting end portion 20 as is shown in FIGS. 1 and 2 for the strip material 11. Upon rotation of the body member 16 in the first rotational direction, any relative rotational movement of the body member 16 with respect to the coiled length of abrasive strip material 11 or 12 will cause the spring 24 to tighten about them both and transmit torque from the body member 16 to the coiled length of abrasive strip material 11 or 12.

The tool 10 also includes means for manually positioning the spring 24 in the aforementioned position at which it holds and transmits torque to the coiled length of abrasive strip material 11 or 12; or for manually removing the spring 24 from the coiled length of abrasive strip material 12 to allow changing it to provide a new abrasive surface. The end portion 26 of the coil spring 24 has a terminal end part 32 which projects radially of the body member 16 and is positioned in a radial bore 33 in a collar 34 slidably and rotatably supported about the transfer portion 18. By manually engaging the collar 34, a user can move the end part 32 to both (1) rotate the spring 24 relative to the body member 16 in the direction it is wound and thereby slightly expand the spring against resistive frictional forces adjacent its opposite end and (2) move the spring axially of the body member 16 so that it will slide onto or off of the peripheries of the transfer portion 18 or the coiled length of abrasive strip material 11 or 12. The end 36 of the spring 24 opposite the radially projecting end part 32 is relieved on its inner surface to restrict its digging into those peripheries when the spring is moved about them; and the body member is chamfered between the transfer portion 18 and the supporting end portion 20 so that the end 36 of the spring 24 can be moved smoothly onto the transfer portion 18 from over the end portion 20. The collar 34 both provides a convenient means whereby a user can manually manipulate the spring 24 to place it around or remove it from around the coiled length of abrasive strip material 11 or 12, and insures that the radially projecting end part 32 of the spring 24 will not snag on a workpiece or on a person using the tool 10.

The length of abrasive strip material used on the tool 10 may, like the strip 12 illustrated in FIGS. 1 and 2, have a uniform width and a predetermined length so that it has a generally cylindrical outer surface of a predetermined diameter adapted for engagement by the spring 24. Alternatively, like the strip 11 illustrated in FIG. 3, it may have a wide end portion 38 with a predetermined length such that when it is coiled it will provide one end portion of the predetermined diameter for the spring 25 to engage; and a narrow end portion 40 which is coiled around the wide end portion to provide a generally cylindrical surface of some larger diameter. This larger diameter may be adjusted by shortening or lengthening the narrow end portion for various purposes, such as to provide the proper diameter to size or polish a hole.

OPERATION

To operate the tool 10, a user first moves the spring 24 entirely onto the central transfer portion 18 of the body member 16 by simultaneously rotating the collar 34 engaged with the end part 32 of the spring 24 in the direction the spring 24 is wound to loosen its grip on the periphery of the transfer portion 18 and pulling the collar 34 to move the spring 24 axially along the body member 16. He then wraps a length of abrasive strip 11 or 12, abrasive side out, around the supporting end portion 20 in the direction opposite that the tool 10 is to be rotated so that the exposed end of the strip material 11 or 12 will be pulled (rather than pushed) across a surface being abraded. The user then holds the coil of abrasive strip material 11 or 12 in position adjacent the distal end of the supporting portion 20 while he again rotates the collar in the direction the spring 24 is wound and pushes it axially along the body member 16 to position the end portion 30 of the spring 24 over a portion of the coiled length of abrasive strip material 11 or 12 of a predetermined length and diameter which portion of the strip material is positioned adjacent the transfer portion 18. The user then releases his grip on the strip material 11 or 12 and continues to rotate the collar 34 as he pulls the collar 34 slightly away from the supporting end portion 20 to move the strip material 11 or 12 firmly against the shoulder between the transfer and supporting portions 18 and 20. The tool 10 is then ready for use and its driven end portion 22 may be engaged with the chuck 13 (such as that of a lathe, drill or routing machine) whereby the coiled length of abrasive strip material 11 or 12 may be rotated to abrade a workpiece. Torque will be transmitted from the chuck 13 to the coil of abrasive strip material 11 or 12 through the body member 16 and by self-tightening engagement of the spring 24 between the transfer portion 18 of the body member 16 and the coil of abrasive strip material 11 or 12. When it is desirable to change the abrasive surface, the spring may be moved back onto the central portion 18 by the method described above, and the abrasive strip material 11 or 12 either replaced or, in the case of the strip material 12, rewound with its end which was innermost during the first winding at the surface of the coil.

EXAMPLE

As a specific non-limiting example, the body member 16 may be a screw machine part of blued steel with its transfer and driven portions 18 and 22 having a common diameter of $\frac{3}{8}$ inch and an overall length of $2\frac{3}{8}$ inch, and its supporting end portion 20 having a diameter of about 0.27 inch and a length of $1\frac{1}{2}$ inch. The spring 24 may have $8\frac{1}{2}$ left hand winds of 0.039 inch spring wire and have a 0.446 inch outer diameter. The collar may have an inside diameter of about 0.378 inch, an outside diameter of $\frac{3}{4}$ inch and an axial length of $\frac{3}{8}$ inch.

I claim:

1. A tool adapted for releasably supporting a length of abrasive strip material in a generally cylindrical coil with its abrasive surface out and for transferring torque applied in a first rotational direction by a drive chuck to rotate the coil about its axis wherein said tool comprises:

a body member having an axis and comprising adjacent transfer and support portions both of which portions have peripheral surfaces which are cylindrical about said axis with the peripheral surface of said support portion being adapted to support a said coiled length of abrasive material thereabout, and a driven end portion about said axis adapted to be engaged by a said chuck;

a coil spring helically wound in a direction opposite said first rotational direction, said spring having one end portion positioned around the transfer portion of said body member with an inner diameter approximately equal to the diameter of said transfer portion and a terminal end part adapted for manual engagement, and an opposite end portion having an inner diameter adapted for engagement with the outer surface of a said abrasive coil about said supporting portion.

2. A tool according to claim 1 wherein said supporting portion has a diameter that is smaller than the diameter of said transfer portion and is adapted so that the outer surface of the adjacent portion of a said coil of abrasive material supported thereabout has about the same outer diameter as said transfer portion.

3. A tool according to claim 1 wherein said tool further comprises a collar engaged with said terminal end part and slidably and rotatably supported about the transfer portion of said body member.

4. A tool according to claim 1 wherein said driven and support portions are end portions of said body member on opposite ends of said transfer portion.

5. An abrading tool having an axis and being adapted to be rotated by a chuck in a first rotational direction about said axis, said tool comprising:

a body member comprising adjacent transfer and supporting portions, both of which portions have peripheral surfaces which are cylindrical about said axis, and a driven end portion about said axis adapted to be engaged by a said chuck;

a length of abrasive strip material in a generally cylindrical coil around the periphery of said support portion and;

a coil spring helically wound in a direction opposite said first rotational direction, said spring having one end portion positioned around the transfer portion of said body member with an inner diameter approximately equal to the diameter of said transfer portion and a terminal end part adapted for manual engagement, and an opposite end portion about the outer surface of an end portion of said cylindrical abrasive coil so that the spring will releasably retain the abrasive strip in a cylindrical coil about said support portion, and will transfer torque applied to said body member in said first rotational direction from said transfer portion to the coil of abrasive strip material.

6. An abrading tool according to claim 5 wherein said supporting portion has a diameter that is smaller than the diameter of the transfer portion and the outer surface of said portion of the coil of abrasive material supported thereabout has about the same outer diameter as said transfer portion.

7. An abrading tool according to claim 5 wherein said tool further comprises a collar engaged with said terminal end part and slidably and rotatably supported about the transfer portion of said body member.

8. An abrading tool according to claim 5 wherein said driven and support portions are end portions of said body member on opposite ends of said transfer portion.

9. An abrading tool according to claim 5 wherein said length of abrasive strip material has a wide end portion of a predetermined length to provide, when coiled, said end portion of said cylindrical abrasive coil engaged by said spring; and a narrow end portion free of said spring coiled about said wide end portion.

10. A method for transferring torque from a chuck rotating in a first rotational direction to a length of abrasive strip material, wherein said method comprises:

providing a body member having an axis comprising adjacent transfer and support portions, both of which portions having peripheral surfaces which are cylindrical about the axis, and a driven end portion about the axis;

coiling the length of abrasive strip material abrasive side out around the periphery of the supporting portion in a direction opposite the first rotational direction;

providing a coil spring wound in a direction opposite said first rotational direction and having one end portion with an inner diameter essentially equal to the outer diameter of said transfer portion and an opposite end portion having an inner surface essentially equal to the outer diameter of at least a portion of the length of abrasive strip material coiled about the supporting portion;

positioning the spring with said one end portion about the transfer portion of the body member and its opposite end portion about the portion of the coiled length of abrasive material about the supporting portion; and engaging the driven end portion with said chuck.

11. A method according to claim 10 wherein the coil spring has an end part on said one end portion, and said positioning step comprises the step of moving said opposite end portion of the coil spring around the coiled length of abrasive strip material by engaging said end part to both rotate the spring in a direction opposite said first rotational direction and move the spring axially of the body member.

12. A method according to claim 10 wherein said length of abrasive strip material has a wide end portion of a predetermined length and a narrow end portion;

said coiling step comprises coiling the wide portion innermost for engagement by said spring and coiling said narrow end portion about said wide end portion; and said method further includes adjusting the length of said narrow end portion to provide a desired outer diameter dimension for the coiled narrow end portion.

* * * * *